United States Patent [19]

Thomas

[11] Patent Number: 4,815,932

[45] Date of Patent: Mar. 28, 1989

[54] PRIMING DEVICE FOR NORMALLY PRIMING CENTRIFUGAL PUMPS

[76] Inventor: Karl W. Thomas, Emsweg 7, 4047 Dormagen, Fed. Rep. of Germany

[21] Appl. No.: 65,856

[22] Filed: Jun. 24, 1987

[30] Foreign Application Priority Data

Jun. 27, 1986 [DE] Fed. Rep. of Germany ..... 3621693

[51] Int. Cl.[4] ..... F04D 9/00

[52] U.S. Cl. ..... 415/168; 55/189; 55/201

[58] Field of Search ..... 415/11, 53 R, 168, 121 R; 417/199 A; 55/159, 201, 189

[56] References Cited

U.S. PATENT DOCUMENTS

| | | | |
|---|---|---|---|
| 2,849,930 | 9/1958 | Freeman et al. | 55/201 X |
| 2,989,143 | 6/1961 | Hallstrom | 55/201 X |
| 3,516,229 | 6/1970 | Nakazawa et al. | 55/201 X |
| 4,545,788 | 10/1985 | Nineuil | 55/201 X |
| 4,561,866 | 12/1985 | Altmann et al. | 55/189 X |

FOREIGN PATENT DOCUMENTS

| | | | |
|---|---|---|---|
| 373039 | 3/1922 | Fed. Rep. of Germany . | |
| 1171746 | 6/1964 | Fed. Rep. of Germany . | |
| 2451529 | 10/1974 | Fed. Rep. of Germany | 417/199 A |
| 740815 | 11/1955 | United Kingdom . | |

*Primary Examiner*—Robert E. Garrett
*Assistant Examiner*—Joseph M. Pitko
*Attorney, Agent, or Firm*—Shlesinger, Arkwright & Garvey

[57] ABSTRACT

A priming device for a centrifugal pump includes a charging arm which has a first end portion for insertion into a liquid to be pumped and a second end portion remote therefrom and of a selected internal diameter. A vertically disposed suction tube extends coaxially from the second end portion. The upper end portion of the suction tube has constriction which reduces the tube internal diameter to less than the internal diameter of the charging arm. A plurality of slots are in the upper end portion for creating fine gas bubbles which flow into the suction tube when the pump is operated. An outer tube is disposed about the suction tube and therewith forms an annular space in which relatively large gas bubbles may rise. The outer tube includes an upper end section secured to the suction tube upper end portion and a lower end section extending below the lower end portion of the suction tube for thereby forming a bubble separator.

3 Claims, 1 Drawing Sheet

PRIMING DEVICE FOR NORMALLY PRIMING CENTRIFUGAL PUMPS

The invention concerns a priming device for normally priming centrifugal pumps, with a suction tube issuing into a bubble separator connected to the suction stub, where this separator eliminates the larger gas bubbles formed while venting the suction conduit.

The German patent No. 373,039 and the British patent No. 740,815 disclose priming systems for normally priming centrifugal pumps, wherein the suction tubes always issue into a container connected to the pump suction stub. The suction tubes assume an ejector shape in the upper region of the container, whereby air is entrained from the particular container and arrives into the liquid. The mouths of the suction tubes are shaped in such a manner that while the liquid can flow into the container, the air column arriving during the start-up stage from the suction tube, as well as the air sucked-in through the ejector, can arrive in their entirety in the pump.

The advantage of these solutions is that after the pump has been shut off, enough liquid remains in the container to easily start the pump again. The liquid which is then aspirated from the container acts like a piston, which so siphons the air column contained into the suction tube and further the liquid to be sucked-in which is behind that a siphon effect comes into being. Accordingly there is no need for priming the compression line with liquid prior to each start-up. And operation of such a suction system is correspondingly simple.

Because of the volume of air arriving from the suction conduit and the additional air aspirated into the ejector, there is in this design pronounced drop in the efficiency of centrifugal pumps. The limit value of 5 to 7% of air content, up to which the efficiency only drops insignificantly, is widely exceeded. This condition remains even after the suction tube has been vented and hence upon termination of the start-up stage, because further large quantities of air are sucked-in through the ejector until the container water level reaches the ejector. Thereupon constant liquid circulation takes place in the container. As a result, the liquid pump must be made much larger than inherently required to assure the motion in the critical start-up stage.

To circumvent this substantial drawback, the German patent No. 11 71 746 follows an entirely different approach In this design a bubble separator known per se precedes the suction stub; this separator operates centrifugally. While it also assumes the shape of a container, its operation is entirely different. Essentially the suction conduit issues tangentially into the bubble separator and accordingly the liquid is made to spin. Consequently the big gas bubbles collect at the center of the container where they set up a gas chamber, while the gas bubbles become even smaller as they near the rim. Because also of the tangential hookup, only a liquid with a very small proportion of bubbles, which furthermore are finely dispersed, arrives into the suction stub. The gas chamber forming in the center of the bubble separator after the aspiration of the gas column in the suction conduit however remains practically maintained during the entire operation of the pump, because this gas cannot reach the moved liquid.

Accordingly the liquid remaining in the bubble separator after the pump has been stopped is insufficient for a new start-up following operational interruption. Consequently, a special supply of liquid is provided in the pressure conduit, whereby the bubble separator can be completely filled for any start-up procedure. On one hand, the provision of a bubble separator in lieu of a liquid supply in the suction region offers the advantage that the pump no longer need be oversize. But this advantage is a tradeoff against the drawback that resort must be made to a special liquid supply in the pressure conduit. As a result, the pump is more complex in design and in operation.

In summary, the two above suction systems differ in basically irreconcilable manner in that in the first, the air coming from the suction conduit is moved directly and totally through the pump, while in the second the attempt is made precisely to avoid this step and to separate the gas as much as possible beforehand. As regards the removal of the gas from the suction tube, the two systems therefore aim in precisely opposite directions, while the particular advantages of each system must be traded off against substantive drawbacks.

It is the object of the present invention to create a priming device which is simple in design and provides self-priming without thereby incurring a drop in pumping efficiency.

Starting with the priming system disclosed in the German patent No. 11 71 746, which comprises a bubble separator in the suction region, the present invention is characterized by the following features:

(a) the mouth of the suction tube is located below the lower operational liquid level, (b) the suction tube comprises at least one gas intake cross-section, (c) the gas intake cross-section is connected with the gas chamber of the bubble separator, (d) the design of the gas intake cross-section is such that the bubbles aspirated from the bubble separator are present in such finely dispersed form that they pass through the bubble separator and arrive in unseparated form in the suction stub, (e) the gas intake cross-section is sized in such a manner that the gas portion aspirated through it shall cause no significant loss in efficiency in the centrifugal pump, and (f) the design of the region below the mouth of the suction tube is such that the larger gas bubbles, which significantly degrade the centrifugal-pump efficiency shall be separated.

This invention is based on the surprising insight that the bubble separator also can simultaneously assume the function of a liquid supply, thereby allowing automatic pump start-up if the gas volume building up in it by the separation of the bubbles is evacuated through the gas intake cross-sections of the invention provided in the suction tube. This aspiration—which heretofore was unknown in bubble separators—lets the liquid level in the bubble separator rise to such a level after the suction tube is vented that enough liquid remains in the bubble separator to start the pump again after it was shut off. No additional supply of liquid is needed in the pressure tube and therefore there is no need for the related, complex operation.

An especial advantage is given in that the aspiration of the gas volume forming in the bubble separator does not entail the drastic drop in pumping efficiency characteristic of the known systems such as are described in the German patent No. 373,039 and the British patent No. 740,815. In the invention, large gas bubbles that might significantly degrade the efficiency of the centrifugal pump cannot be entrained by the separating operation of the bubble separator into the centrifugal pump, instead they rise in the bubble separator. For that purpose, the mouth of the suction tube is designed correspondingly; that is, the large gas bubbles exiting the suction tube float on account of their buoyancy. This can be carried out concretely by selecting the spacing between the mouth of the suction tube and the suction stub to be correspondingly large, and to be the larger the more directly the mouth is aimed at the suction stub and the higher the speed of the exiting mixture of liquid and gas.

Another essential feature of the invention is in the special design of the gas intake cross-section aspirating the gas cushion into the bubble separator. On one hand, it is made small enough that the gas portion evacuated through it is less than the gas portion at which a centrifugal pump shows the characteristic collapse in efficiency. On the other hand, the invention provides that the gas bubbles arrive only in finely dispersed form through the gas intake cross-section into the suction tube. Because of the previously mentioned separation effect of the bubble separator restricted to large gas bubbles, these finely dispersed gas bubbles can pass through the bubble separator and arrive in unseparated form in the suction stub. Both features ensure that the gas cushion in the bubble separator shall be evacuated without a significant drop in efficiency of the centrifugal pump.

In order to achieve finely dispersed gas bubbles, a gas intake cross-section with a sharp-edged deflection is most suitable, preferably at the narrowest cross-section of a constriction of the suction tube.

Advantageously furthermore the gas portion of the liquid exiting the bubble separator shall be a maximum of 5% but preferably only 1 to 3%.

In a further design of the invention, the free gas intake cross-section is a slot in the suction tube. Such slots are easily made, for instance by grinding or sawing, and result in especially fine gas bubbles when the gas is evacuated from the bubble separator. This effect is enhanced by the free gas intake cross-section being located in a cross-sectional constriction, if possible at the narrowest site.

Separation is favored by mounting an impact body, for instance a transverse plate, in the area of the free end of the suction tube.

Especially where large suction heights are involved, it is recommended that the suction tube and the bubble separator be designed as tubular bodies mounted in mutually coaxial manner. The result is a slender manufactured body which furthermore can be made from standard parts. Such large heights are found in discharge stations for tanker vehicles.

The invention further provides that, in order to achieve a helical liquid direction of flow, that part of the suction tube which enters the bubble separator shall issue in the circumferential direction. Appropriately, the suction stub then shall also be connected tangentially to the bubble separator.

To control the aspirated amount of gas, the free gas intake cross-section in the suction tube shall be variable, for instance by means of an externally accessible slider or valve. In this manner the particular aspirated gas quantity or rate can be adjusted optimally in such a manner that, on one hand the gas volume in the bubble separator is quickly evacuated and on the other hand, the value shall not be reached at which the pump output drops drastically.

The invention is illustrated in closer detail in relation to an illustrative embodiment shown in the drawing:

FIG. 1 illustrates a reservoir 1, a discharge facility and a tanker vehicle 3.

Figure 2:
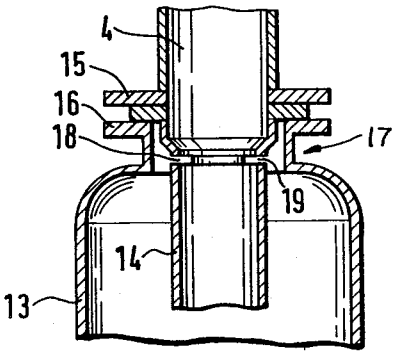
FIG. 2 is an enlarged fragmentary cross-sectional view of the portion II of the discharge facility of FIG. 1.
Figure 1:
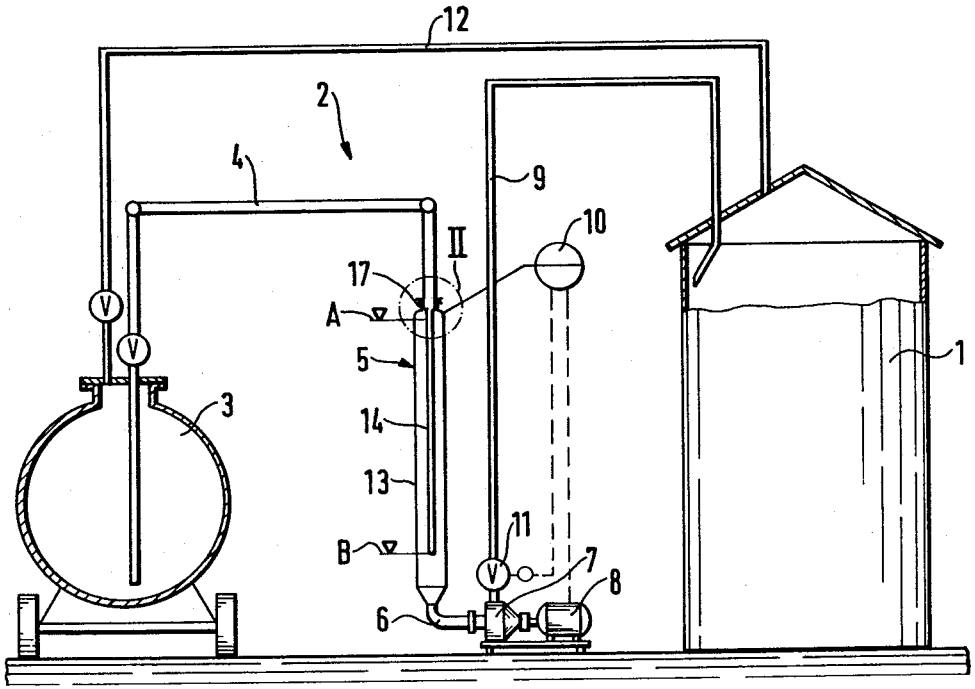
FIG. 1 is a schematic of a tanker-vehicle discharge facility.

The discharge facility 2 comprises a multi-hinge charging arm 4 movable by means of devices not shown herein. The charging arm 4 forms a suction tube to evacuate the Liquid in the tanker vehicle 3. A slender bubble separator 5 is connected to the charging arm 4, and comprises at its lower end a suction stub 6 to a centrifugal pump 7. The centrifugal pump 7 is driven by an electric motor 8. Its pressure conduit 9 goes into the reservoir 1.

The upper region of the bubble separator 5 is accessible to a float switch 10 connected both to the centrifugal pump 7 and a valve 11 in the pressure conduit 9. A gas compensating line 12 furthermore is provided between the tanker vehicle 3 and the reservoir 1.

The bubble separator 5 consists of an outer tube 13 entered by a narrowed suction-tube segment 14. This segment issues at a spacing from the suction stub 6. As shown in FIG. 2, the suction-tube segment 14 is clamped at its upper end between the flanges 15, 16 of the charging arm 4 and the outer tube 13. It comprises a cross-sectional constriction 17 and immediately below two slots 18, 19.

The discharge facility 2 operates as follows:

, First the charging arm 4 and the gas compensating line 12 are connected through predetermined apertures to the tanker vehicle 3 which has already moved into position. In the bubble separator 5, liquid remains from the previous discharge procedure at a level A which is slightly below the slots 18, 19. The level A substantially matches the arrangement of the float switch 10.

The discharge procedure is initiated by opening the valve 11 and starting the centrifugal pump 7. This pump aspirates the liquid in the bubble separator 5 and moves it through the pressure conduit 9 into the reservoir 1. As a result the liquid level in the bubble separator 5 drops and a partial vacuum is created, causing the discharge arm 4 to siphon the liquid out of the tanker vehicle. This automatic siphoning of the liquid starts before the liquid level in the bubble separator 5 reaches the level B corresponding to the mouth of the suction-tube segment 14.

The siphoned liquid forces the gas column in the charging arm 4—which mostly is an inert gas—ahead of it toward the centrifugal pump 7. As it exits from the mouth of the suction-tube segment 14, the gas column substantially dissolves into large bubbles. The spacing between this mouth and the suction stub 6 on one hand and the cross-section of the outer tube are so sized that large gas bubbles do not enter the suction stub 6, rather they rise in the annular space between the suction-tube segment 14 and the outer tube 13. Accordingly, the region below the mouth of the suction-tube segment 14 is designed in such a manner that, under normal pumping conditions, those gas bubbles are separated that might degrade the efficiency of the centrifugal pump 7. Only relatively small gas bubbles are entrained into the suction stub 6, their size and their quantities being such, in the light of the design of the bubble separator 5, that the limit value for that gas content at which the efficiency of the centrifugal pump 7 drops drastically shall not be reached. Below this limit value, the loss in efficiency due to entrained gas bubbles is negligibly small.

Large gas bubbles develop such a buoyancy that they will not be entrained into the suction stub 6, rather they rise in the bubble separator 5 to the liquid surface. The gas volume so formed above the liquid level is evacuated through the two slots 18, 19 in the suction tube segment 14. Because of the cross-sectional constriction present there, the static pressure in the suction tube segment 14 is so low that the gas is aspirated into the moved liquid. Contrary to the case for injectors or ejectors, the sharp-edged slots 18, 19 assure the formation of very fine gas bubbles which are moved downward together with the liquid and which, at the exit from the suction-tube segment, are not separated but instead are entrained into the suction stub 6. The cross-sections of the slots 18, 19 are so sized that the gas content in the liquid does not reach the limit value already mentioned above at which the efficiency of the pump 7 drops sharply. In this manner gas circulation in the bubble separator 5 is restricted to the start-up stage.

By evacuating the gas volume in the bubble separator 5, the liquid surface again can rise to the level A. Depending on design, from three to ten minutes will be required. The end of the change-over procedure again is related to a lowering of the liquid level. This is sensed by the float switch 10. This switch closes the valve 11 and turns off the centrifugal pump 7 and furthermore emits a signal. Thereupon the initial condition is reached again.

Obviously the bubble separator 5 also can be designed differently. Illustratively the suction-tube segment 14 might issue only in the lower region into the bubble separator 5. The entry might be tangential to centrifugally support the separation. The gas volume forming in the bubble separator 5 then is evacuated by means of a connecting conduit between the upper region of the bubble separator 5 and the slots 18, 19 of the suction-tube segment 14. The connection conduit may be provided with a valve to optimally adjust the aspirated flow of gas volume. Alternatively, the cross-sections of the slots 18, 19 may be set by sliders.

What is claimed is:

1. A primary device for a centrifugal pump, comprising:

(a) a charging arm including a first end portion for insertion into a liquid to be pumped and a second end portion remote therefrom and of a selected internal diameter;

(b) a vertically disposed suction tube extending coaxially from said second end portion and including an upper end portion and a lower end portion, said upper end portion having a constriction reducing said tube internal diameter to less than the internal diameter of said second end portion;

(c) a plurality of slots in said upper end portion, each slot having a sharp-edged deflection for creating fine gas bubbles which flow into said suction tube when the pump is operated; and, (d) an outer tube disposed about said suction tube and therewith forming an annular space in which gas bubbles may rise to said slots, said outer tube includes an upper end section secured to said upper end portion and a lower end section extending below said lower end portion for thereby forming a bubble separator and said lower end section includes an outlet for operable connection with an inlet of the pump.

2. The device of claim 1, wherein:

(a) said slots are disposed below said constriction.

3. The device of claim 1, wherein:

(a) float switch means operably associated with said upper end portion for controlling operation of the pump.

* * * * *